United States Patent [19]

Boulanger

[11] 3,998,418

[45] Dec. 21, 1976

[54] LANTERN HOLDER

[76] Inventor: Peter F. Boulanger, Elm St., Box 458, Kincaid, Ill. 62540

[22] Filed: Nov. 22, 1974

[21] Appl. No.: 526,077

[52] U.S. Cl. ..... 248/309 R; 248/539; 240/57.1

[51] Int. Cl.[2] ..... A47F 5/00; F21L 15/10; F21L 19/00

[58] Field of Search ..... 248/38, 39, 43, 309, 248/310, 311; 240/52.1, 57.1, 74, 82, 84, 7.5; 24/103, 201; 70/61, 234; 256/1, 19; 40/128, 144; 224/42.03 R, 42.1 G, 42.45 R, 42.45 A, 42.45 B, 42.46 R, 42.46 A, 42.46 B

[56] References Cited

UNITED STATES PATENTS 605,628 6/1898 Bradley ..... 70/234

*Primary Examiner*—Robert A. Hafer
*Attorney, Agent, or Firm*—Daniel Jay Tick

[57] ABSTRACT

A rod-like post of linear configuration is bent near one end thereof at an obtuse angle with the remainder of the length thereof and dimensioned at the one end to be accommodated in an oarlock of a boat. The post has a slot formed therein at the other end thereof extending diametrically for accommodating the bail of a lantern whereby the post supports a lantern in upright position above a boat.

4 Claims, 4 Drawing Figures

LANTERN HOLDER

BACKGROUND OF THE INVENTION

The present invention relates to a lantern holder. More particularly, the invention relates to a lantern holder for a boat having oarlocks.

Boatmen in open boats often need light at night and utilize lanterns to provide such light. In such event, a boatman must hold a lantern with one hand, so that he has only one free hand for performing other functions. This is not only inconvenient, but dangerous, since it requires an extra occupant to carry the lantern or creates a hazardous situation when only one hand is available to do the work of two.

The principal object of the invention is to provide a lantern holder for a boat having oarlocks for supporting a lantern in a substantially upright position above the boat.

An object of the invention is to provide a lantern holder of simple structure, which is inexpensive in manufacture, storable in a minimum space and installed and removed with facility, convenience and rapidity.

Another object of the invention is to provide a lantern holder of sound, sturdy and durable structure which requires no maintenance or repair and functions efficiently, effectively and reliably to support a lantern above a boat.

Still another object of the invention is to provide a lantern holder of simple, durable structure for supporting a lantern in an upright position above a boat in a secure and safe manner.

BRIEF SUMMARY OF THE INVENTION

In accordance with the invention, a lantern holder comprises a substantially rod-like post of substantially linear configuration bent near one end thereof at an obtuse angle with the remainder of the length thereof and dimensioned at the one end to be accommodated in an oarlock of a boat. The post has a slot formed therein at the other end thereof and extending substantially diametrically for accommodating the bail of a lantern whereby the post supports a lantern in substantially upright position above a boat.

The area of the one end of the post is externally threaded. Two nuts are in threaded engagement with the post in the area of the one end thereof for securing the post in an oarlock. Each nut is secured at a corresponding end of the oarlock.

A first bore is formed through the other end of the post extending substantially diametrically and perpendicularly to the slot and intersecting the slot. A second bore is formed through the post at a predetermined distance from the slot and extending parallel to the first bore. An eyebolt extends through the second bore and is affixed to the post. A lock pin removably passes through the first bore. Linking means couples the lock pin to the eyebolt in a manner whereby the lock pin is secured to the post via the linking means and is selectively positionable in the first bore to prevent the bail of a lantern from slipping out of the slot of the post.

A substantially band-like member has a hook extending therefrom at one end. A spring member has an eye formed in one end thereof and is affixed at the other end thereof to the other end of the band-like member for removably fastening the fuel can of the lantern to the post.

BRIEF DESCRIPTION OF THE INVENTION

In order that the invention may be readily carried into effect, it will now be described with reference to the accompanying drawing, wherein.

In the FIGS., the same components are identified by the same reference numerals.

DETAILED DESCRIPTION OF THE INVENTION

Figure 1:
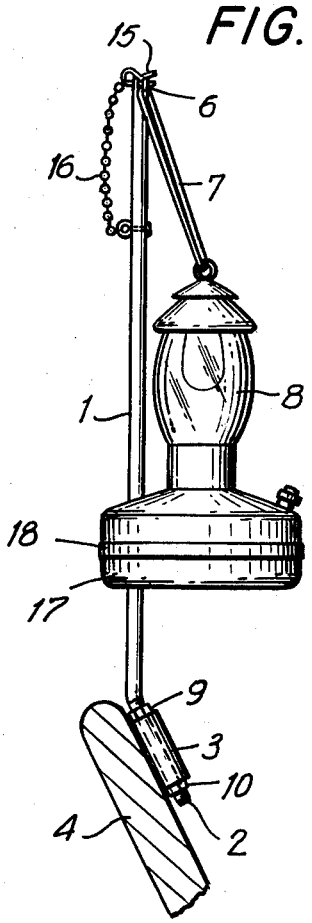
FIG. 1 is a view of an embodiment of the lantern holder of the invention in use supporting a lantern.

The lantern holder of the invention comprises a substantially rod-like post 1 (FIGS. 1, 2 and 4) of substantially linear configuration, bent near one end 2 thereof at an obtuse angle with the remainder of the length thereof. The post 1 is dimensioned at the end 2 to be accommodated in an oarlock 3 of a boat 4 (FIG. 1).

Figure 4:
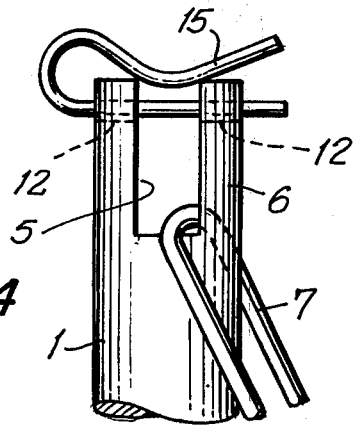
FIG. 4 is a view, on an enlarged scale of the other end of the post of the embodiment of FIG. 1.

The post 1 has a slot 5 (FIGS. 2 and 4) formed therein at the other end 6 thereof. The slot 5 extends substantially diametrically of the post 1 and accommodates the bail 7 of a lantern 8, as shown in FIGS. 1 and 4. The lantern 8 comprises any suitable known lantern having a bail. The post 1 supports a lantern 8 in substantially upright position above a boat 4, as shown in FIG. 1.

The area of the end 2 of the post 1 is externally threaded. Two nuts 9 and 10 (FIGS. 1 and 2) are in threaded engagement with the post 1 in the area 11 of the end 2 thereof. The nuts 9 and 10 secure the post 1 in the oarlock 3. The nut 9 is secured at the top of the oarlock 3 and the nut 10 is secured at the bottom of the oarlock.

Figure 2:
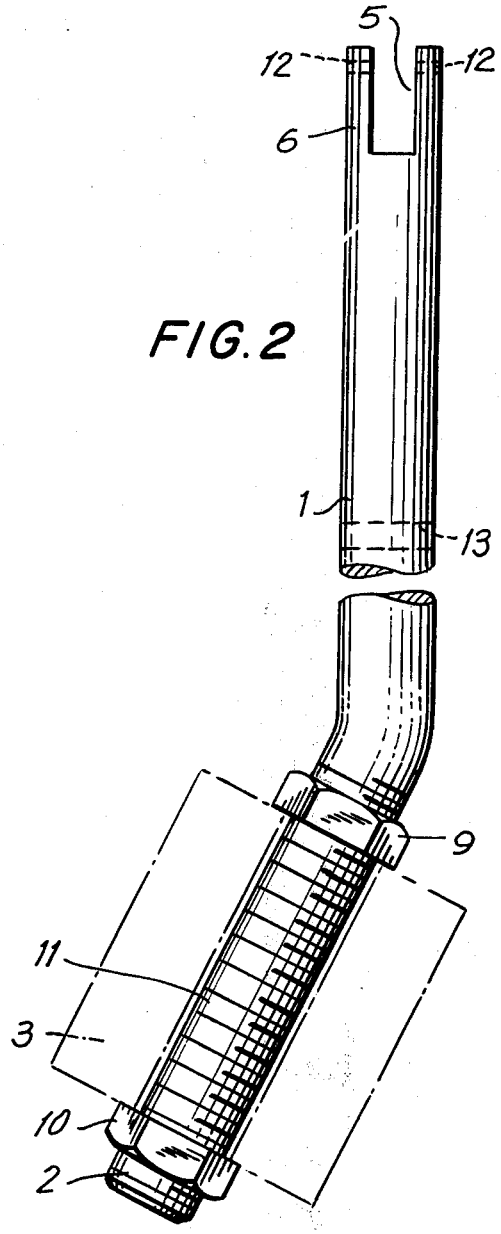
FIG. 2 is a view, on an enlarged scale, of the embodiment of the lantern holder of FIG. 1.

A first bore 12 is formed through the end 6 of the post 1, as shown in FIGS. 2 and 4, and extends substantially diametrically and perpendicularly to the slot 5 and intersects the slot.

A second bore 13 is formed through the post 1 at a predetermined distance from the slot 5 and extends parallel to the first bore 12. An eyebolt 14 (FIG. 1) extends through the second bore 13 and is affixed to the post 1. A lock pin 15 (FIG. 1) removably passes through the first bore 12.

A linking device 16 (FIG. 1) of any suitable type such as, for example, a cord, chain, or the like, couples the lock pin 15 to the eyebolt 14 in a manner whereby the lock pin is secured to the post 1 via the linking device and is selectively positionable in the first bore 12 to prevent the bail 7 of the lantern 8 from slipping out of the slot 5 of the post, as shown in FIGS. 1 and 4.

Figure 3:
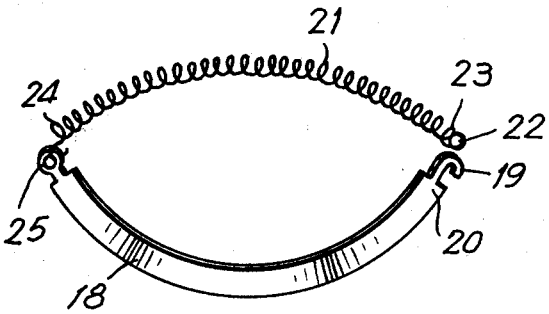
FIG. 3 is a view, on an enlarged scale, of an embodiment of the fuel can support member of the invention.

The lantern has a fuel can, or any suitable container or can 17 for carrying lantern fuel such as, for example, gasoline (FIG. 1). The fuel can support member of the invention comprises a substantially band-like member 18 having a hook 19 extending therefrom at one end 20 (FIG. 3). The member 18 passes around part of the circumference of the fuel can 17 of the lantern, as shown in FIG. 1. A spring member 21, of any suitable type, (FIG. 3) has an eye 22 formed in one end 23 thereof. The spring member 21 is affixed at the other end 24 thereof to the other end 25 of the member 18, as shown in FIG. 3, for removably fastening the fuel can 17 of the lantern to the post 1.

The post 1 of the lantern holder of the invention fits an oarlock on either side of a boat, so that any one fishing in the boat may always look away from the lantern. In other words, the lantern may always be positioned behind a fisherman in the boat, so that the light of the lantern always falls on the fishing equipment and illuminates the boat at the same time.

While the invention has been described by means of a specific example and in a specific embodiment, I do not wish to be limited thereto, for obvious modifications will occur to those skilled in the art without departing from the spirit and scope of the invention.

I claim:

1. A lantern holder for supporting a lantern having a bail in a substantially upright position above an oarlock of a boat, said lantern holder comprising a substantially rod-like post of substantially linear configuration bent near one end thereof at an obtuse angle with the remainder of the length thereof and dimensioned at the one end to be accommodated in an oarlock of a boat, the area of the one end of the post being externally threaded, said post having a slot formed therein at the other end thereof and extending substantially diametrically for accommodating the bail of a lantern whereby the post is adapted to support a lantern in substantially upright position above an oarlock of a boat;

a first bore formed through the other end of the post extending substantially diametrically and perpendicularly to the slot and intersecting said slot; and a lock pin removably passing through the first bore to prevent the bail of the lantern from slipping out of the slot of the post.

2. A lantern holder as claimed in claim 1, further comprising two nuts in threaded engagement with the post in the area of the one end thereof adapted to secure the post in an oarlock, each nut being adapted to be secured at a corresponding end of an oarlock.

3. A lantern holder as claimed in claim 2, further comprising a second bore formed through the post at a predetermined distance from the slot and extending parallel to the first bore, an eyebolt extending through the second bore and affixed to the post, and linking means coupling the lock pin to the eyebolt in a manner whereby the lock pin is secured to the post via the linking means.

4. A lantern holder as claimed in claim 3, wherein the lantern includes a fuel can, and further comprising a substantially band-like member having a hook extending therefrom at one end and a spring member having an eye formed in one end thereof and affixed at the other end thereof to the other end of the band-like member for removably fastening the fuel can of the lantern to the post.

* * * * *